US006687564B2

(12) United States Patent
Baudry et al.

(10) Patent No.: US 6,687,564 B2
(45) Date of Patent: Feb. 3, 2004

(54) SYSTEM FOR AUTOMATICALLY CONTROLLING THE SPREADING OF A TEXTILE SHEET

(75) Inventors: Yvon Baudry, Merignac (FR); Robert Jean, Fouqueville (FR); Jean Pascal Pirodon, Villefontaine (FR)

(73) Assignee: Messier-Bugatti, Velizy-Villacoublay (FR)

( * ) Notice: Subject to any disclaimer, the term of this patent is extended or adjusted under 35 U.S.C. 154(b) by 134 days.

(21) Appl. No.: 09/880,302

(22) Filed: Jun. 13, 2001

(65) Prior Publication Data

US 2002/0123819 A1 Sep. 5, 2002

(30) Foreign Application Priority Data

Mar. 2, 2001 (FR) ..... 01 02867

(51) Int. Cl.[7] ..... G06F 19/00; G01N 33/36
(52) U.S. Cl. ..... 700/130; 28/282
(58) Field of Search ..... 700/130, 57, 59; 28/107, 185, 282; 26/75; 19/65 T, 65 A

(56) References Cited

U.S. PATENT DOCUMENTS

| | | | | |
|---|---|---|---|---|
| 4,790,052 A | | 12/1988 | Olry | 28/110 |
| 4,962,576 A | | 10/1990 | Minichshofer et al. | 28/110 |
| 5,146,651 A | * | 9/1992 | Duffy et al. | 28/282 X |
| 5,214,828 A | | 6/1993 | Neuert et al. | 28/282 |
| 5,226,217 A | | 7/1993 | Olry et al. | 28/107 |
| 5,239,457 A | * | 8/1993 | Steidle et al. | 700/57 |
| 5,781,973 A | | 7/1998 | Orzel | 26/75 |
| 6,029,327 A | | 2/2000 | Sheehan et al. | 28/107 |

FOREIGN PATENT DOCUMENTS

| | | |
|---|---|---|
| EP | 0 493 050 A1 | 7/1992 |
| FR | 2 741 634 A1 | 5/1997 |
| FR | 2 761 380 | 10/1998 |
| FR | 2 761 380 A1 | 10/1998 |
| GB | 1 308 999 | 3/1973 |
| GB | 1 449 641 | 9/1976 |
| JP | 11-012913 | 1/1999 |
| WO | WO 97/15708 | 5/1997 |

* cited by examiner

*Primary Examiner*—Peter Nerbun
(74) *Attorney, Agent, or Firm*—Weingarten, Schurgin, Gagnebin & Lebovici LLP

(57) ABSTRACT

Apparatus for automatically controlling the spreading of a textile sheet made up of a plurality of tows coming from a tow feed module and serving to feed a drive module, the apparatus comprises means for measuring the positions of the longitudinal edges of each tow, means for individually adjusting the width of each tow, means for individually adjusting the position of each tow in a direction perpendicular to a tow advance direction, and digital processor means responsive to said position measuring means to control the adjustment means in such a manner that the textile sheet presents determined width and position.

14 Claims, 4 Drawing Sheets

SYSTEM FOR AUTOMATICALLY CONTROLLING THE SPREADING OF A TEXTILE SHEET

FIELD OF THE INVENTION

The present invention relates to the field of needled textile structures and it relates more particularly to a system for automatically controlling the spreading of tows that are to form such textile structures.

PRIOR ART

In traditional industrial needling processes, the textile sheet which is to be needled and which is to be used for example in making protective parts for use at high temperatures, is made up from a plurality of tows placed side by side and each comprising a multitude of textile yarns advantageously of the monofilament type. Each tow comes from a device known as a creeling frame and it exits over a width and at a position that ought, a priori, to enable distribution to be as uniform as possible within the sheet (also referred to as a tow web).

At present, this distribution is provided purely manually by an operator located at the outlet from the creeling frame, with the operator constantly watching the sheet, particularly where tows overlap, and wherever possible manually altering the way it is spread so as to limit imperfections. Unfortunately, when such imperfections are found to be excessive, the process must be interrupted and that gives rise to severe consequences. In addition to the method being particularly expensive in terms of labor costs (particularly if the process is to be performed 24 hours a day), it is not free from defects due to the presence of the human factor.

OBJECT AND DEFINITION OF THE INVENTION

The present invention mitigates those drawbacks by proposing apparatus for automatically controlling the spreading of a textile sheet made up of a plurality of tows coming from a tow feed module for feeding to a drive module, the apparatus comprising means for measuring the positions of the longitudinal edges of each tow, means for individually adjusting the width of each tow, means for individually adjusting the position of each tow in a direction perpendicular to a tow advance direction, and digital processor means responsive to said position measuring means to control said adjustment means in such a manner that said textile sheet presents determined width and position.

With this particular configuration, it is possible automatically to obtain uniform distribution of the textile sheet whose width and position are thus completely guaranteed and controlled in real time so as to enable it to be introduced into a pre-needling module or directly into a cross-layer.

Advantageously, the means for measuring the positions of the longitudinal edges of each tow comprise either a digital camera placed over the textile sheet or else a detector, preferably a linear optical sensor made up of a plurality of light-emitting diodes placed in register with a plurality of light-receiving diodes with the tow to be measured passing between them. Likewise, the means for individually adjusting the width of each tow comprise a curved adjustment bar which is pivoted about a pivot axis under drive from a first actuator, thereby altering the position of the curve in its central portion which has the effect of acting on the width of the tow passing over said curved adjustment bar. Similarly, the means for individually adjusting the position of each tow in a direction perpendicular to a tow-advance direction comprise a second actuator acting on a bell crank and a connecting rod to move a slider supporting the tow. The first and second actuators are preferably electrically-controlled actuators that are actuated directly by said digital processor means.

The digital processor means comprise a microcomputer or a programmable controller which, on the basis of said measurements picked up by said position detector, controls said first and second actuators to adjust the width and the position of each tow so as to ensure that the width and the position of said textile sheet are regulated relative to predetermined reference values. Advantageously, these predetermined reference values comprise the total width Nc of the sheet, the nominal overlap between tows R1*c*, R2*c*, R3*c*, and the width Lc of an individual tow. Nevertheless, only the referenced values relating to said total width of the sheet and to said nominal overlap are supplied to said digital processor means by an operator, while the reference value relating to the width of an individual tow is calculated automatically by said processor means on the basis of said reference values that are supplied by an operator.

The invention also provides a method of implementing this apparatus for automatically controlling the spreading of a textile sheet.

BRIEF DESCRIPTION OF THE DRAWINGS

The characteristics and advantages of the present invention will appear more clearly on reading the following description given by way of non-limiting indication and with reference to the accompanying drawings, in which.

DETAILED DESCRIPTION OF A PREFERRED EMBODIMENT

Figure 1:
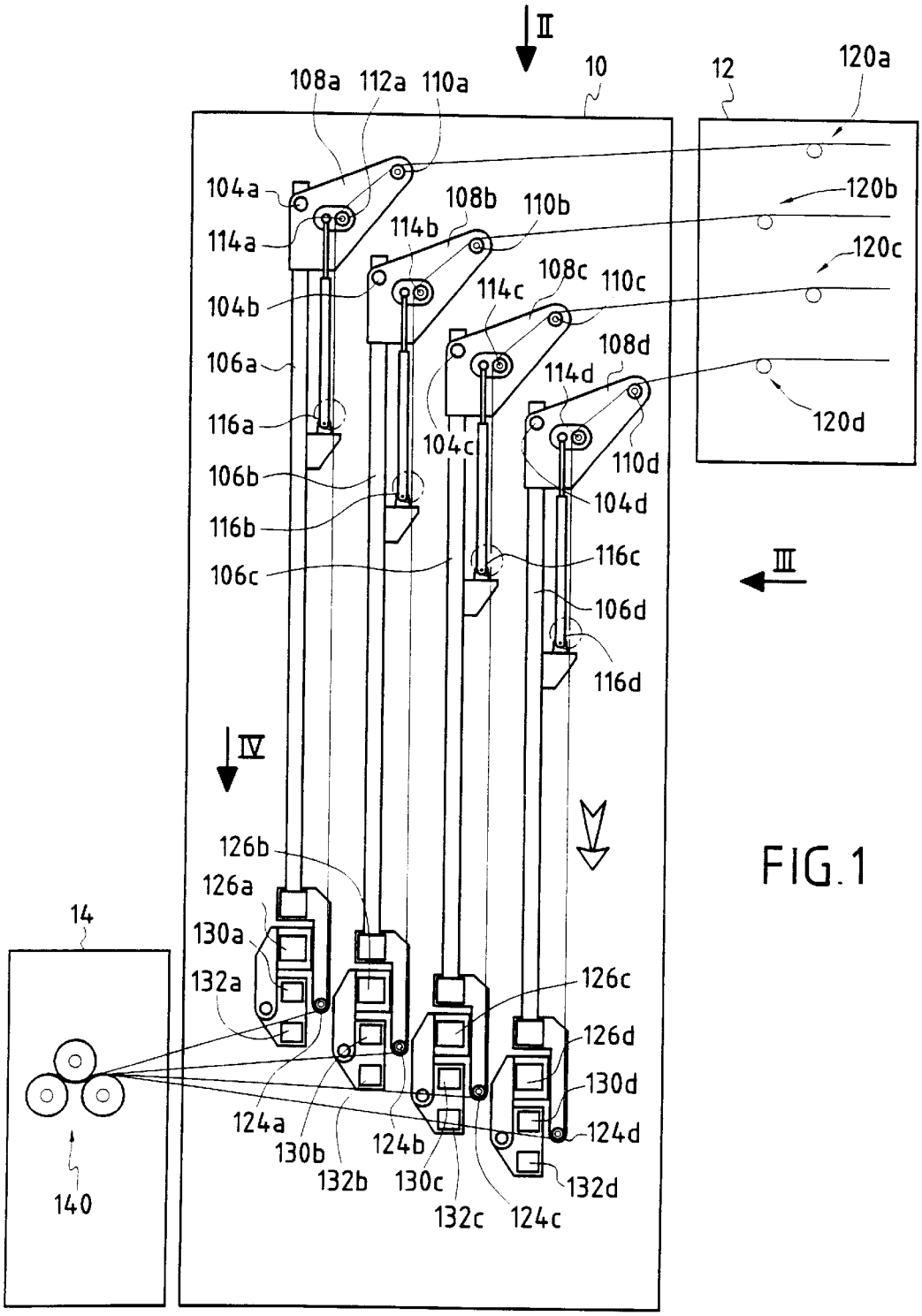
FIG. 1 is a diagrammatic side view of apparatus of the invention for automatically controlling the spreading of a textile sheet.

Apparatus for automatically controlling the spreading of a textile sheet is shown diagrammatically in FIG. 1.

The apparatus 10 is placed in a conventional creeling frame between a tow feed module 12 and a tow drive module 14. The drive module can also be integrated in a pre-needling module or in a cross-layer. In the example shown, the feed module 12 which is placed in a plane that is higher than the drive module, delivers four tows 16*a*, 16*b*, 16*c*, and 16*d* which leave in an advance direction between respective deflector bars 120*a*, 120*b*, 120*c*, and 120*d* disposed at four different levels. Naturally, this number of tows is not limiting in any way and it is entirely possible to use some other number, which can be smaller (at least two) or greater, and the only limitation is the space available for installing the apparatus. The drive module 14 has a series of pinch rollers 140 (also referred to as a driving press) which take up and drive the sheet formed by the four above-mentioned tows once they have been uniformly distributed by the apparatus 10 of the invention for controlling spreading.

Between two side uprights 100 and 102 that form a stand, the automatic apparatus comprises tour first supporting cross-members 104*a*, 104*b*, 104*c*, and 104*d* that form guide rails and that are disposed at different levels which are offset slightly from the four levels of the deflector bars, with each supporting cross-member carrying a slider (or frame) 106*a*, 106*b*, 106*c*, and 106*d* that move transversely between the uprights in a direction perpendicular to the tow advance direction and intended to support the tow as it passes through the apparatus.

Figure 2:
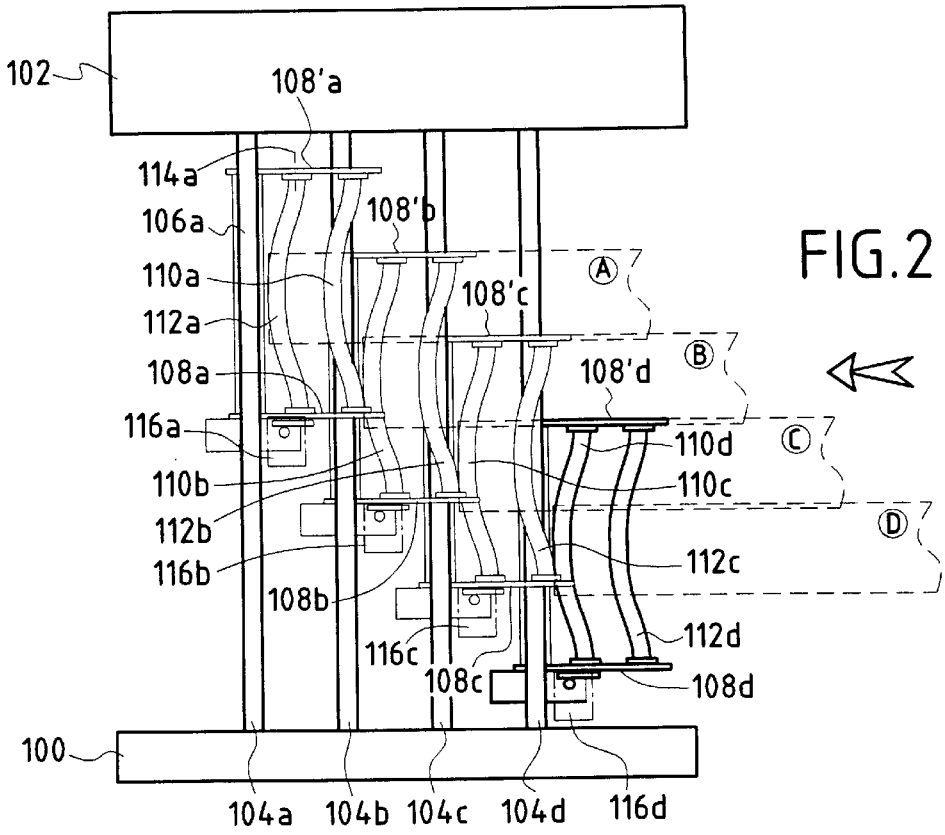
FIG. 2 is a view of FIG. 1 on plane II.
Figure 3:
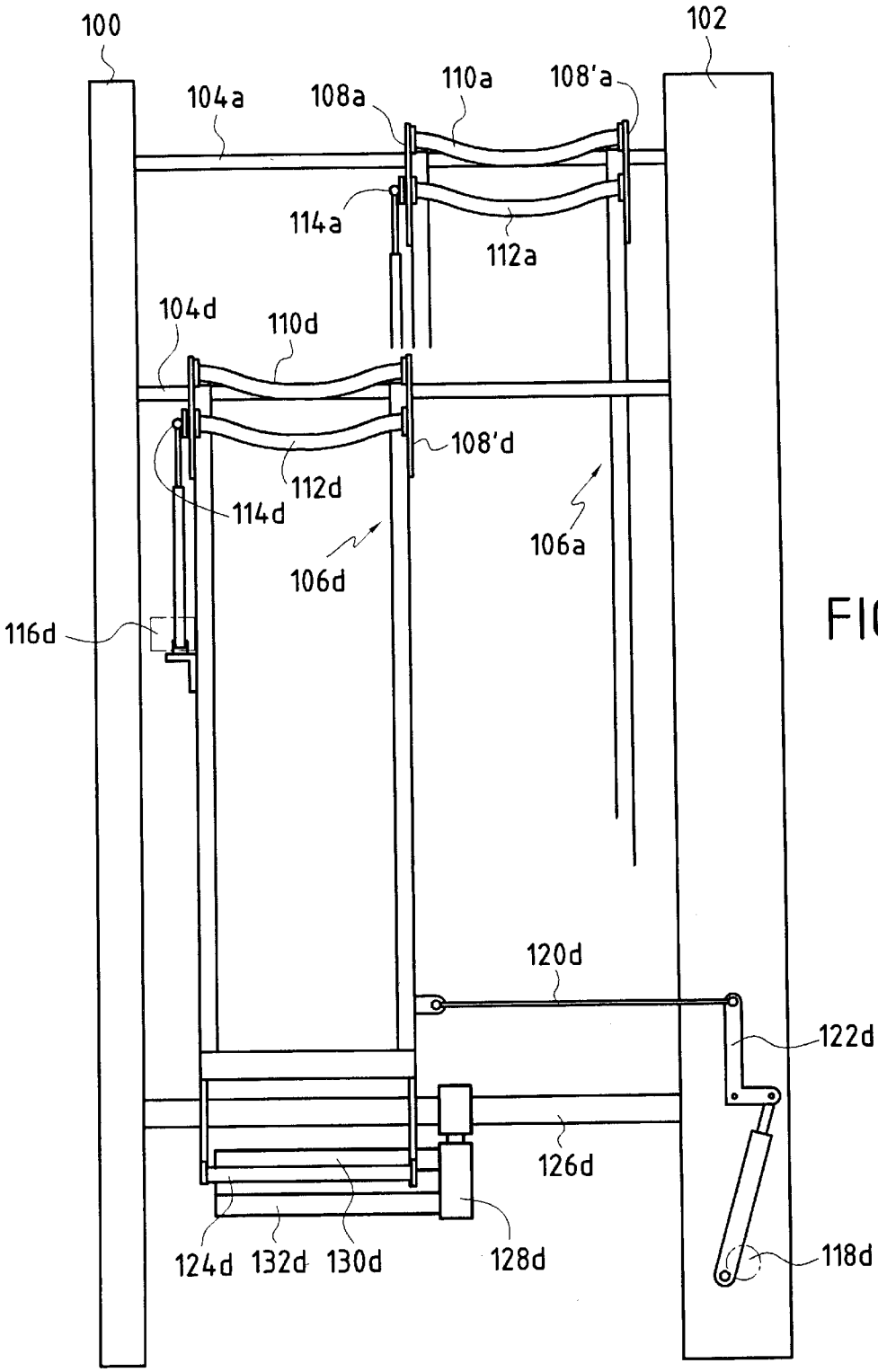
FIG. 3 is a view of FIG. 1 on plane III.

On a top portion of the slider (level with its supporting cross-member), and on either side thereof, there are fixed two cheek plates 108*a*, 108*b*, 108*c*, 108*d*; 108'*a*, 108'*b*, 108'*c*, 108'*d*, as can be seen in FIGS. 2 and 3, which cheek plates have mounted between them, one above another, a fixed first centering bar 110*a*, 110*b*, 110*c*, 110*d* and means for adjusting tow width formed by an adjustment bar 112*a*, 112*b*, 112*c*, 112*d* that is movable about a respective axis 114*a*, 114*b*, 114*c*, 114*d* with pivoting thereabout being under the control of a respective first actuator 116*a*, 116*b*, 116*c*, 116*d* which is preferably electrically controlled and which is mounted on the slider.

The fixed centering bar is substantially in alignment with the corresponding deflector bar and is preferably a curved bar, i.e. its central portion is curved into a banana shape. However it is also possible to use a straight centering bar. In contrast, it is necessary for the moving adjustment bar to be curved into a banana shape, with its pivoting about its pivot axis under drive from the first actuator having the effect of changing the position of the curvature of its central portion which, by changing between a concave shape and a convex shape serves to vary the width of the tow passing over the curved bar. Thus, a convex shape corresponds to a width that is greater than the width which corresponds to a concave shape.

Figure 4:
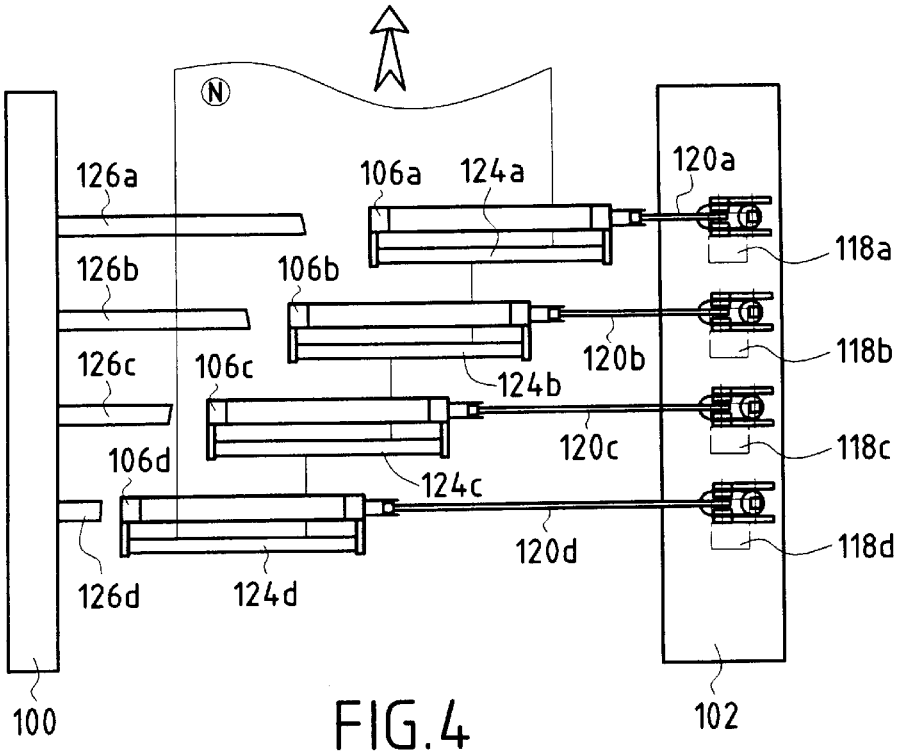
FIG. 4 is a view of FIG. 1 on plane IV.

The sideways displacement of each slider is controlled to adjust the individual position of each tow as can be seen in FIGS. 3 and 4 which show the four second actuators 118*a*, 118*b*, 118*c*, 118*d* which are preferably under electrical control, each acting via a respective bell crank 122*a*, 122*b*, 122*c*, 122*d* on a respective connecting rod 120*a*, 120*b*, 120*c*, 120*d* connected to the bottom portion of the corresponding slider. These second actuators are advantageously mounted in one of the side uprights (102) of the stand. On this bottom portion of each slider there is mounted, substantially level with the drive press 140, a second fixed centering bar 124*a*, 124*b*, 124*c*, 124*d* that acts as a deflector bar to deflect the tow traveling down the slider towards the inlet of the drive module 14.

The width and the position of each tow within the sheet are measured to determine the total width of the sheet by means of four detectors each mounted on a second supporting cross-member 126*a*, 126*b*, 126*c*, 126*d* likewise extending between the side uprights 100, 102 substantially level with the bottom ends of the respective sliders. Each detector 128*a*, 128*b*, 128*c*, 128*d* is advantageously constituted by a linear optical sensor (preferably an infrared light strip of width greater than the width of an individual tow) made up of a plurality of light-emitting diodes (LEDs) 130*a*, 130*b*, 130*c*, 130*d* placed in register with a plurality of light-receiving diodes 132*a*, 132*b*, 132*c*, 132*d*, and with the tow that is to be measured passing between them, each sensor being mounted on the corresponding support cross-member so as to detect at least in the vicinity of the two longitudinal sides of the tow and preferably over its entire width. It will be observed that it is advantageous to replace these detectors by a single digital camera placed in such a position above the textile sheet as to enable it to cover the entire width of the sheet in its field of view.

Figure 5:
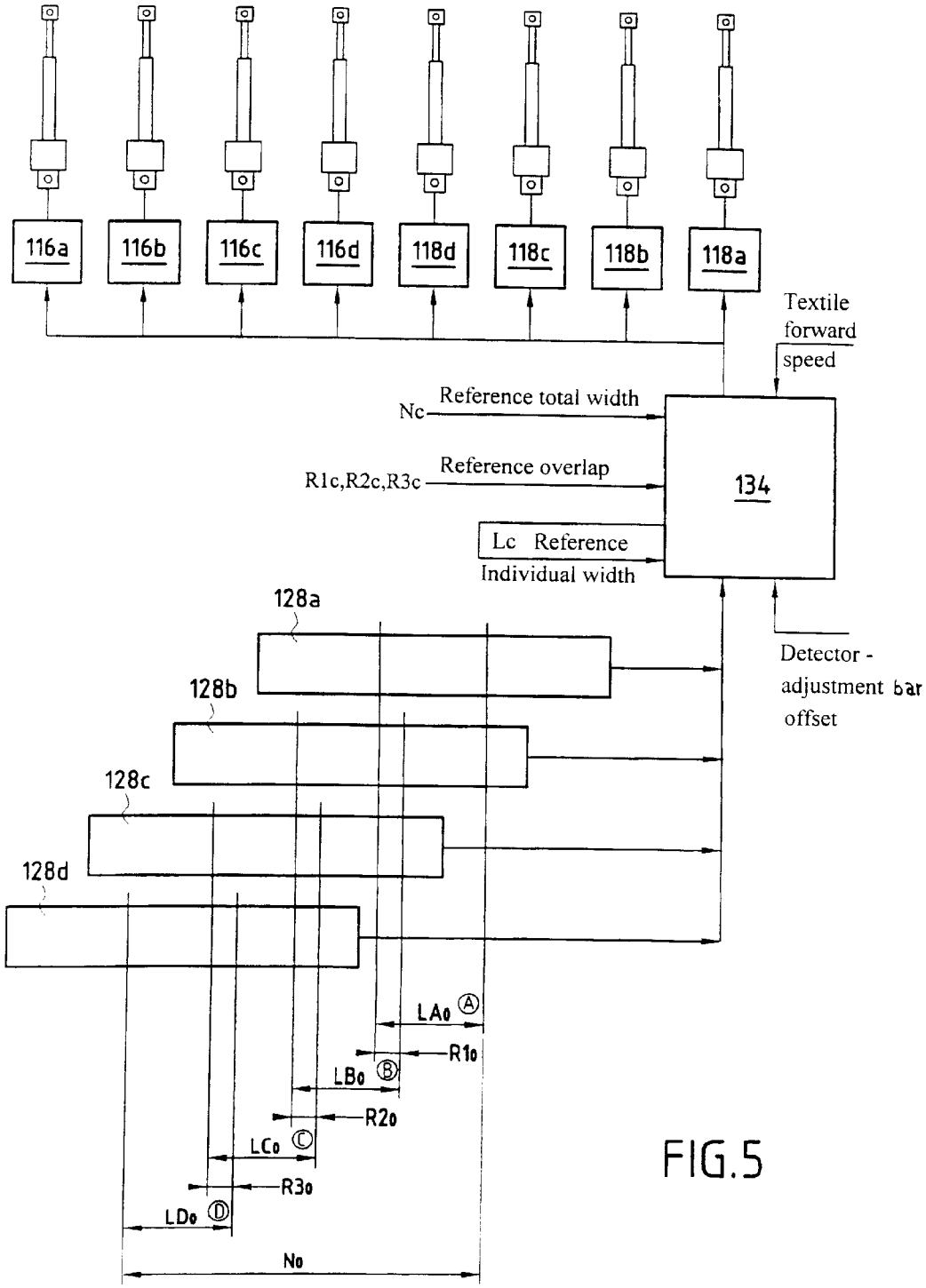
FIG. 5 shows the various electronic modules that control the apparatus of the invention.

Automatic control is provided by digital processor means (see FIG. 5), preferably a microcomputer or a programmable controller 134 which receives position information from the detectors 128*a*, 128*b*, 128*c*, 128*d* and which derives internal parameters from this information to actuate the various electrically controlled actuators 116*a*, 116*b*, 116*c*, 116*d*; 118*a*, 118*b*, 118*c*, 118*d* for controlling movements of the adjustment bars and of the sliders. The parameters taken into account are essentially the forward travel speeds of the tows that are to make up a textile sheet and the distance that exists between each detector and the pivot axes of the adjustment bars. The controller performs real time regulation relative to three reference values: the desired total width of the sheet (reference total width Nc), the desired nominal overlap between tows (reference overlaps R1*c*, R2*c*, R3*c*), and the individual tow width (reference individual width Lc), so as to obtain a uniform distribution of the textile fibers making up the sheet. Only the first two reference values are provided by the operator to the digital processor means which then automatically calculates the reference value Lc. By way of example, excellent results have been obtained with the following reference values (given in millimeters):

Nc=530 mm, R1*c*=R2*c*=R3*c*=10 mm, Lc=140 mm

The apparatus 10 operates as follows. Naturally it is assumed that the tows A, B, C, and D of non-uniform distribution and of width that is not necessarily correct (generally too narrow) are initially extracted from the module 12 and then the sheet N which is formed in the apparatus is introduced into the module 14 which serves to drive it. Each of the tows passes in succession over the first centering bar 110 and then the associated adjustment bar 112 which, in its initial position, has its curvature in a position that corresponds to the reference values, and finally over the second centering bar 124. In this initial position, i.e. before the sheet is driven continuously, each detector provides accurate information about the exact position of the tow relative to a predetermined fixed frame of reference, and it monitors said position. This information comprises the position of each of the two longitudinal edges of each tow, from which the width of the tow is deduced. The information from all four sensors can be used to determine an initial value NO for the total width of the sheet, three initial values (which might be identical) for the various overlaps, R10 for the overlap between tows A and B, R20 for the overlap between tows B and C, and R30 for the overlap between tows C and D, and also four initial values LA0, LB0, LC0, and LD0 for the individual widths of the tows. It is by comparing these initial values and values measured subsequently Ni, Ri, Li with the predetermined reference values that the processor means 134 performs regulation.

This real time regulation is performed in application of three successive priority levels, the highest priority being given to obtaining a total sheet width that complies with the reference width input by the operator. To do this, the outermost tows A and D are initially adjusted so that their outermost edges define the desired sheet width Nc. This adjustment bears both on the positions of the two sliders and of the two adjustment bars supporting these two outermost tows. Thereafter, the overlaps are brought into balance by adjusting the central tows B and C so that their respective edges overlap one another and the inner edges of the outermost tows in substantially similar manner in compliance with the nominal reference overlaps R1*c*, R2*c*, R3*c* likewise input by the operator. Here again, adjustment bears both on the positions of the two sliders and on the positions of the two adjustment bars supporting these two central tows. Finally, adjustment bearing on the positions of all of the sliders and of all of the adjustment bars supporting the central tows and the outermost tows is performed so as to obtain individual tow widths that match the reference individual width Lc as defined by the controller. It will be observed that the width of individual tows is adjusted so as to obtain the reference overlaps which in turn cannot themselves be regulated to the detriment of regulating the total width of the sheet which is the highest priority.

In the example shown, given the closeness of the detector 128 to the second centering bar 124, correcting the position of a tow by moving the slider has an immediate effect on the position of the tow. In contrast, correcting the width of a tow by causing the adjustment bar to pivot involves a time delay because of the distance (position offset) that exists between the detector and the adjustment bar 112 and because the textile yarns making up the tow do not spread instantly, which is why it is necessary to know both said distance and the speed of advance of the sheet and to define them as internal parameters.

What is claimed is:

1. Apparatus for automatically controlling the spreading of a textile sheet made up of a plurality of tows coming from a tow feed module for feeding to a drive module, the apparatus comprising means for measuring the positions of the longitudinal edges of each of the plurality of tows, means for individually adjusting the width of each tow, means for individually adjusting the position of each tow in a direction perpendicular to a tow advance direction, and digital processor means responsive to said position measuring means to control said adjustment means in such a manner that said textile sheet presents determined width and position.

2. Apparatus according to claim 1, wherein said means for measuring the positions of the longitudinal edges of each tow comprise a detector, preferably a linear optical sensor made up of a plurality of light-emitting diodes placed in register with a plurality of light-receiving diodes, and with the respective tow to be measured passing between them.

3. Apparatus according to claim 1, wherein said means for measuring the positions of the longitudinal edges of each tow comprise a digital camera placed over said textile sheet.

4. Apparatus according to claim 1, wherein said means for individually adjusting the width of each tow comprise a curved adjustment bar whose pivoting about a pivot axis under drive from a first actuator has the effect of modifying the position of the curvature of the central portion of the bar, thereby acting on the width of the tow passing over said curve adjustment bar.

5. Apparatus according to claim 1, wherein said means for individually adjusting the position of each tow in a direction perpendicular to an advance direction of the tows comprise a second actuator acting on a bell crank and a connecting rod to move a slider supporting the tow.

6. Apparatus according to claim 4, wherein said first and second actuators are electrically controlled actuators that are actuated directly by said digital processing means.

7. Apparatus according to claim 2, wherein said first and second actuators are electrically controlled actuators that are actuated directly by said digital processing means, and wherein said digital control means include a microcomputer or a programmable controller which, on the basis of said measurements made by said position detectors, controls said first and second actuators for adjusting the width and the position of each tow in such a manner as to regulate the width and the position of said textile sheet on the basis of predetermined reference values.

8. Apparatus according to claim 7, wherein said predetermined reference values comprise a total sheet width Nc, a nominal overlap between tows Rc, and an individual tow width Lc.

9. Apparatus according to claim 8, wherein only the reference values relating to said total sheet width and to said nominal overlap are provided to said processor means by an operator, with the reference value relating to said individual tow width being calculated automatically by said processor means on the basis of said reference values provided by the operator.

10. A method of automatically controlling the spreading of a textile sheet made up of a plurality of tows, the method comprising:

detecting the longitudinal edges of each tow;

calculating tow widths Li for each tow;

calculating overlap values Ri corresponding to overlaps between tows;

calculating a total textile sheet width value Ni based on the detected position of each longitudinal edges of each tow;

comparing the values of Li, Ri, and Ni with reference values Lc, Rc, Nc, respectively; and adjusting the width and the position of one or more tows so as to reduce the difference between the measured values of Li, Ri, and Ni and the reference values Lc, Rc, and Nc, respectively.

11. A method according to claim 10, wherein the width and the position of each tow is individually controlled as a function of three successive priority levels: firstly the total width of the textile sheet is adjusted to said predetermined reference value Nc, secondly overlaps between tows are balanced to comply with the predetermined reference overlap values Rc, and finally the individual width of each tow is adjusted to comply with the predetermined reference value Lc.

12. A method according to claim 10, wherein the positions of the longitudinal edges of the tows are measured in a position that is offset relative to the positions of said actuators for controlling the width of each tow.

13. Apparatus for automatically controlling the spreading of a textile sheet made up of a plurality of tows coming from a tow feed module for feeding to a drive module, the apparatus comprising means for measuring the positions of the longitudinal edges of each of the plurality of tows, a second actuator acting on a bell crank and a connecting rod to move a slider supporting the tow, wherein the position of each tow are adjusted in a direction perpendicular to a tow advance direction, and digital processor means responsive to said position measuring means to control said adjustment means in such a manner that said textile sheet presents determined width and position.

14. An apparatus for automatically controlling the formation of a textile sheet made from a plurality of tows, comprising:

a detector for locating a transverse position of respective edges of each of the plurality of tows;

a computing device constructed and arranged to determine widths Li of each tow, an overlap Ri between adjacent tows, and a width Ni of the textile sheet, based on the detected transverse positions of the edges of each of the plurality of tows;

a comparator constructed and arranged to compare determined values of Li, Ri, and Ni with respective reference values Lc, Rc, and Nc;

an adjustment system controlled in accordance with comparison results from said comparator for adjusting widths and transverse positions of the respective tows so as to make the values of Li, Ri, and Ni approach the reference values Lc, Rc, and Nc.

* * * * *

UNITED STATES PATENT AND TRADEMARK OFFICE

CERTIFICATE OF CORRECTION

PATENT NO. : 6,687,564 B2
DATED : February 3, 2004
INVENTOR(S) : Yvan Baudry et al.

It is certified that error appears in the above-identified patent and that said Letters Patent is hereby corrected as shown below:

Title page,
Item [75], Inventors, "Yvon Baudry" should read -- Yvan Baudry --; and Column 4,
Line 30, "NO" should read -- N0 --.

Signed and Sealed this

Fifteenth Day of March, 2005

JON W. DUDAS
*Director of the United States Patent and Trademark Office*